US008810378B1

(12) United States Patent
Norman et al.

(10) Patent No.: US 8,810,378 B1
(45) Date of Patent: Aug. 19, 2014

(54) ENHANCED REMOTE CONTROLS FOR ROBOTS

(75) Inventors: David Anthony Norman, Greenville, TX (US); Robert H. Mimlitch, Rowlett, TX (US); Corey Lee Chitwood, Greenville, TX (US); Richard D. Torrance, Greenville, TX (US); Mark J. Lambert, Greenville, TX (US)

(73) Assignee: Innovation First, Inc., Greenville, TX (US)

( * ) Notice: Subject to any disclaimer, the term of this patent is extended or adjusted under 35 U.S.C. 154(b) by 1318 days.

(21) Appl. No.: 11/736,547

(22) Filed: Apr. 17, 2007

Related U.S. Application Data

(60) Provisional application No. 60/792,794, filed on Apr. 18, 2006.

(51) Int. Cl.
*G08C 19/12* (2006.01)

(52) U.S. Cl.
USPC ..... 340/13.34; 340/12.22; 340/12.3; 340/12.31; 340/12.5; 340/13.22; 340/13.24; 340/13.25; 340/13.28; 318/568.11; 318/568.12; 318/568.17; 318/581; 446/6; 446/31; 446/454; 446/456

(58) Field of Classification Search
CPC ..... H04Q 1/453; H04Q 1/46; H04Q 1/4535; H04Q 1/457; G08C 19/14
USPC ..... 340/825.29, 2.24, 2.26, 2.28, 2.31, 340/12.22, 12.27, 12.31, 13.22, 13.24, 340/13.25, 13.28, 13.29, 13.34; 455/556.1, 455/83, 88, 91, 92, 550.1; 446/6, 31, 454, 446/456; 701/29; 901/6, 8, 36; 318/568.11, 318/568.12, 568.17, 581
See application file for complete search history.

(56) References Cited

U.S. PATENT DOCUMENTS

| | | | | |
|---|---|---|---|---|
| 6,324,443 | B1 | 11/2001 | Kurakake et al. | |
| 6,481,013 | B1 * | 11/2002 | Dinwiddie et al. | 725/80 |
| 6,674,259 | B1 | 1/2004 | Norman et al. | |
| 7,181,241 | B2 * | 2/2007 | Fukuda | 455/556.1 |
| 7,193,384 | B1 | 3/2007 | Norman et al. | |
| 7,222,684 | B2 | 5/2007 | Norman et al. | |
| 7,236,850 | B2 | 6/2007 | Kim et al. | |
| 7,291,054 | B2 * | 11/2007 | Choi | 446/454 |
| 2003/0014766 | A1 * | 1/2003 | Dinwiddie et al. | 725/126 |
| 2004/0082268 | A1 * | 4/2004 | Choi | 446/454 |
| 2006/0019705 | A1 * | 1/2006 | Fukuda | 455/556.1 |
| 2006/0094442 | A1 * | 5/2006 | Kirkup et al. | 455/455 |
| 2006/0229034 | A1 | 10/2006 | Gizis et al. | |
| 2006/0238500 | A1 | 10/2006 | Olshansky et al. | |
| 2006/0242323 | A1 * | 10/2006 | Sanderford et al. | 709/245 |

* cited by examiner

*Primary Examiner* — Benjamin C Lee
*Assistant Examiner* — Sisay Yacob
(74) *Attorney, Agent, or Firm* — Adam K. Sacharoff; Much Shelist

(57) ABSTRACT

This disclosure relates to enhanced control of user configurable devices, such as robots. One system may include a user-configurable device and an on-vehicle programmable controller coupled to the user-configurable device. This system may further include a wireless receiver coupled to the on-vehicle programmable controller via one signal wire, where a substantial portion of the receiver-controlled communications occur using the one signal wire. Another system may include (alternatively or in combination as appropriate) a user-configurable device including an on-vehicle programmable controller and a first tether port. The system may also include a remote control transmitter with at least one wireless output and a second tether port, where the transmitter is communicably coupled to the user-configurable remote control device.

12 Claims, 5 Drawing Sheets

ENHANCED REMOTE CONTROLS FOR ROBOTS

RELATED APPLICATION

This application claims the priority under 35 U.S.C. §119 of provisional application Ser. No. 60/792,794 filed Apr. 18, 2006.

TECHNICAL FIELD

This disclosure relates to robots and, more specifically, to enhanced control of a user configurable device, such as the robot. For example, this disclosure may include a remote control (R/C) system with various enhancements that facilitate (potentially increased) communications among the various components.

BACKGROUND

Although specific radio technology has improved, the basic input and output (I/O) of conventional R/C equipment for flying hobby planes, driving ground vehicles, or otherwise controlling robots or robotic vehicles have remained relatively unchanged for years. For example, the typical system includes a handheld transmitter, a remotely mounted receiver, and a servo or speed controller. The handheld transmitter may include human inputs two joysticks, trim tabs, and aux switches. There are commonly servo reversing switches. More modern enhancements include programmable controls on the transmitter that allow modification of the human input prior to transmission. Such modifications may allow for improved control parameters and the ability to adjust the human input as necessary for different vehicle configurations. Many transmitters have a trainer port that allows a second transmitter to be properly connected to the first transmitter and enabled, allowing a student to take over flying, while the teacher with the main transmitter can enable and disable student control. Generally, the function of the remotely mounted receiver is to receive the handheld transmitters signal, decode the data, and distribute the appropriate human input to a specific output connector. Receivers typically have between two and eight outputs, each mapped to a specific human input, such as one joystick axis or one switch. The servo (or speed controller) is normally wired to (at least) one of the outputs of the receiver is a device for controlling the movement of the vehicle. Servos create rotational movement to a specific position, allowing for control of airfoil surfaces, steering linkages, and such. Speed controllers take the same signal as a servo and allow for control of continuously rotating motors for wheel drive or propeller drive.

SUMMARY

This disclosure relates to enhanced control of user configurable devices, such as robots. For example, one system may include a user-configurable device and an on-vehicle programmable controller coupled to the user-configurable device. This system may further include a wireless receiver coupled to the on-vehicle programmable controller via one signal wire, where a substantial portion of the receiver-controlled communications occur using the one signal wire. In another example, the system may include a user-configurable device including an on-vehicle programmable controller and a first tether port. The system may also include a remote control transmitter with at least one wireless output and a second tether port, where the transmitter is communicably coupled to the user-configurable remote control device.

While generally described as systems, some or all of these aspects may be further included in respective software for executing, implementing, or otherwise supporting such enhanced control. The details of these and other aspects and embodiments of the disclosure are set forth in the accompanying drawings and the description below. Other features, objects, and advantages of the present disclosure will be apparent from the description and drawings, and from the claims.

DETAILED DESCRIPTION

Figure 1:
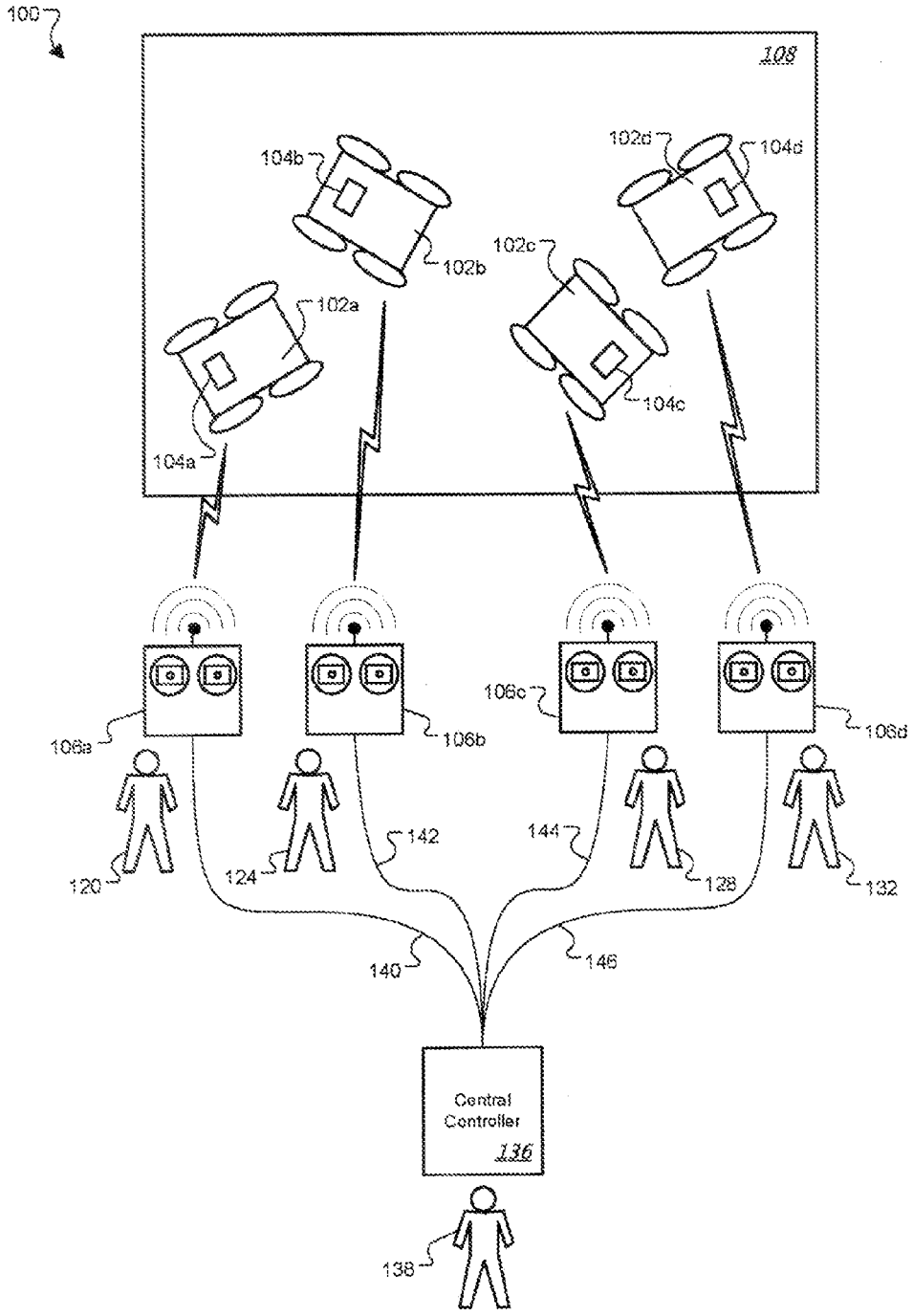
FIG. 1 shows an example robotic competition that includes several transmitters, several robots, and a central controller according to one implementation of the present disclosure.

At a high level, this disclosure describes control of a user configurable device 102 such as a robot. Each robot 102 typically includes an on-vehicle programmable controller (OVPC) 104, which generally executes, manages, or otherwise includes software for controlling the robot's functions (e.g., communications, motors, actuators, sensors, power). Normally, the one or more operators use a remote control transmitter 106 to control the respective robot 102 using wired and/or wireless communications (perhaps through a receiver). Using one or more components or techniques described in this disclosure creates or otherwise facilitates enhanced control of these robots 102.

For example, this disclosure describes an R/C system with the ability to pass data between the receiver and the OVPC with only one signal wire (or an otherwise reduced number of inputs). The typical receiver has between 2 and 8 outputs, often corresponding to the number of inputs of the transmitter. In systems that employ the OVPC, a modified receiver circuit is used that does not de-mux data into its individual components. This muxed data can then passed (or otherwise transmitted) via one wire from the receiver to the system's microprocessor. In addition to reducing the required number of valuable microcontroller inputs, the programming code and load on the microprocessor may be reduced. In another example R/C system, the system allows multiple operators to collaborate to control one vehicle. As the functions of competition robots increase, it is desirable to allow two people to assist in control. Often by reducing the number of inputs on the OVPC's microprocessor, the microprocessor can easily handle two receiver inputs.

In yet another example, an R/C system may include the ability to bypass the wireless transmission/reception with a wire. R/C systems often use fixed frequencies for transmission, of which there are a limited number. During large competition events, many teams may want to be testing, repairing, and otherwise using their system while simultaneous competition events are taking place. Thus, a wired bypass may be used to help ensure that there are enough frequencies for competing. In this circumstance, a port is added to the transmitter that helps attach a cable between the transmitter and the OVPC. This cable allows the same data that is usually transmitted wirelessly to be passed or otherwise transmitted. The transmitter can automatically detect that the cable has been connected, via circuitry or other software detecting the OVPC, and disable the transmitter's RF output. The data signal connected to the tether port can be the not modulated data. This allows the receiver's demodulation circuit to be bypassed and the receiver circuit is not needed. The cable is connected into the port on the OVPC that receiver one was connected. A second transmitter can be similarly connected to the port that the optional receiver was connected to. In a further example, an R/C system may have the ability to remotely disable the transmitter. During competition events, a synchronized start time among multiple competitors is often important. Using the same tether port on the transmitter, a cable is attached between each transmitter and a central controller. This controller can, via a switch on computer control, enable and disable the transmitter as necessary. In this case, the same mechanism that tells the transmitter to disable when tethered is used.

In yet a further example, an R/C system may include non joystick inputs that are reconfigured for more ergonomic control. Typical R/C non joystick inputs consist of a momentary or multi-position toggle switch. An enhanced location and control method is used. First, the buttons may be located on the back of the controller in convenient locations that do not require the thumbs to be removed from the joystick. Two buttons are employed for each hand, aligned with the middle and index fingers. The two momentary buttons are used to drive a specific channel in the forward or reverse direction. In the case of a servo, pressing the index finger button may cause a servo to rotate clockwise or a motor to turn clockwise, while the middle finger does the opposite. In this example, releasing both buttons returns to servo center or motor off. The button's functions can easily be reconfigured by the programming the OVPC, allowing multiple functions. In one embodiment, by programming an example button matrix, as many as eight different functions can the initiated with four buttons. But, using various techniques and data structures, any suitable number of functions may be mapped, dynamically associated, or otherwise correlated with any number of buttons.

Turning to the illustrated implementations, FIG. 1 shows an example robotic competition 100 using a playfield 108. In some cases, the playfield 108 may be a zone that constitutes an "in bounds" area including a playfield, a cage, an arena, and so forth. For example, user-configurable devices 102 (such as robots described in more detail in FIG. 2) may participate in an activity that takes place within a defined boundary or walled enclosure. As illustrated, four robots 102A-D are participating in the competition within the bounds of the playfield 108. In some embodiments, the playfield 108 and the robots 102A-D may be configured to perform a particular competitive activity. For example, the robots 102A-D may be used to play a version of tag, soccer, or other game or the robots 102A-D may compete to race, navigate an obstacle course, move objects, or perform other various tasks.

The illustrated competition 100 also includes a central controller 136, which generally is a control system that includes one or more processors and respective software for controlling a plurality of robots, often (but not always) in a competition setting. At a high level, the central controller 136 allows a referee 138 to remotely active transmitters 106 or robots 102 via tether cables, which may be up to 25 feet long (or even longer in other circumstances). In other words, the central controller 136 can include any number of tether ports to help manage any number of transmitters 106. Generally, each tether port represents any port intended to connect to a controller interface using a "hard" wire connection—such as a DB9 Female-Female Pin-to-Pin cable or an RJ-11 4 PIN phone extension cable—instead of using a wireless radio link. For example, the central controller 136 can include an appropriate XPST switch, where X is the number of transmitters to be controlled. In this case, when the switch is open the transmitters are ON and when the switch is closed the transmitters are OFF. In some embodiments, the central controller 136 may include functions for temporarily disabling the transmitters 106A-D. For example, the referee 138 may operate the central controller to disable remotely the transmitters 106A-D prior to the start of a competitive activity. The referee 138 may then concurrently enable the remote transmitters 106A-D (or a subset thereof) at the start of the competitive activity, at which time the operators may control the actions of the robots 102. In some examples, the referee 138 may use the central controller 136 to disable remotely the transmitters 106A-D at the end of the competitive activity and/or to halt the activity for some other reason. The central controller 136 communicates with the transmitters 106A-D through tether cables (e.g., a tether cable 140, a tether cable 142, a tether cable 144, and a tether cable 146, each which may be the same or different types of cables). In some cases, connecting the tether cable to the respective transmitter may disable the transmitter until the central controller 136 enables the transmitter remotely. Also, the direct communications through the tether cable 140 may comprise unmodulated data.

Figure 2:
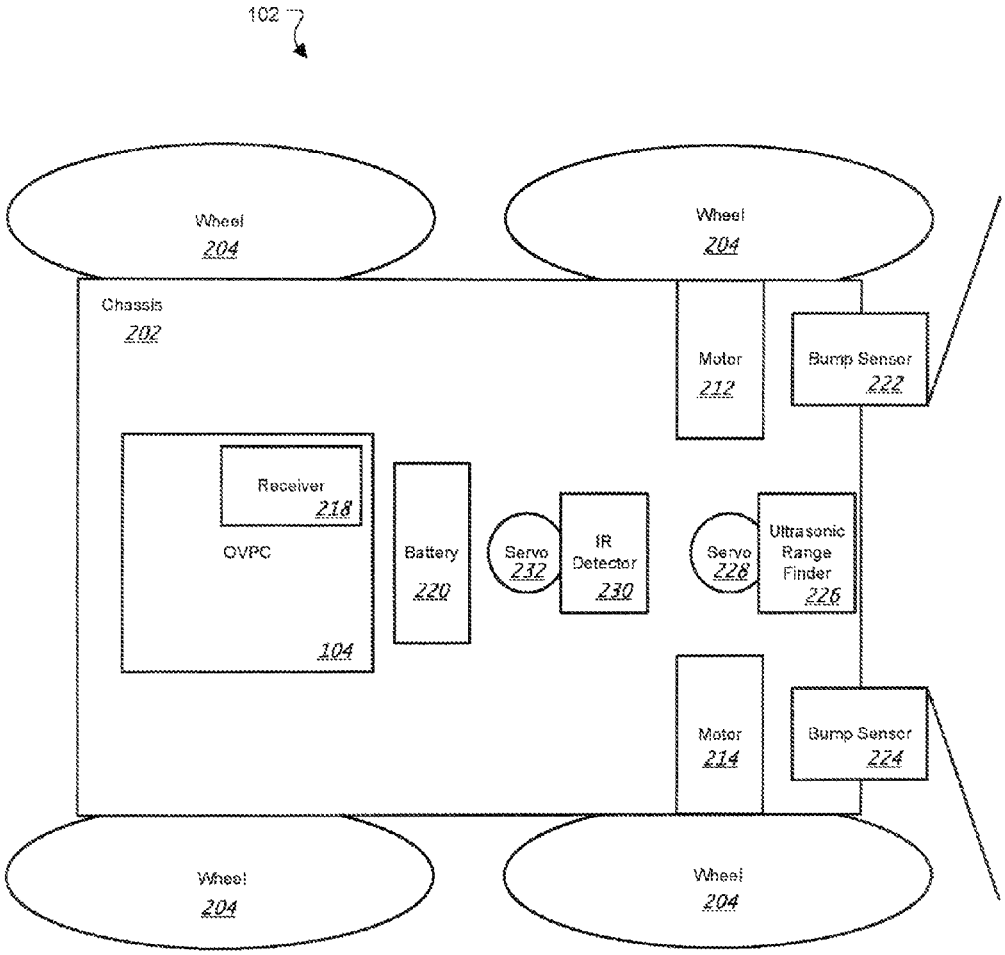
FIG. 2 illustrates an example robot that includes an on-vehicle programmable controller module and various other modules.

FIG. 2 illustrates an example robot 102. Among other structure and motion devices (such as chassis 202, a set of wheels 204), the illustrated robot 102 also includes an OVPC 104, a receiver module 218, and a battery module 220. The battery module 220 provides electrical power to the robot 102. For example, the battery module 220 may include a 7.2V battery pack for the robot. The batteries can be NiCd (Nickel-Cadmium chemical composition) rechargeables that provide relatively significant energy.

OVPC 104 generally represents a control system that is operable to receive, retrieve, or otherwise collect user commands and other information, gather additional data and information from sensors on-board the robot 102, dynamically determine how the robot 102 should function based on predefined parameters and algorithms, and instruct the robot 102 to perform these functions. For example, OVPC 104 can include four fast R/C PWM (radio controlled, pulse width modulated) outputs capable of being refreshed every 2 mSec, sixteen fast digital inputs/outputs, sixteen fast analog inputs (with perhaps 10-bit resolution), one or more fast TTL (transistor transistor level), RS232, RS485, or other compatible serial ports, one or more processors, and 1800 bytes of memory with 32 kilobytes of program space. In this example, the PWM outputs may be used to drive speed controllers and servos and/or to control a variable speed motor from a joystick axis. Moreover, each of the PWM outputs may generate a PWM signal corresponding to a specific output of a user's program or other customized code. The relay outputs are often used to drive bi-directional relay modules, to drive small motors in Full Forward, Full Reverse, or Off, and/or to turn On or Off solenoids, pumps, and lights from a joystick button. Each of the eight ports may generate two binary signals corresponding to a specific output of the user's program. The analog inputs can be used to measure various conditions on the robot and trigger automatic responses by the control program. Typically, any sensor (such as potentiometers and gyro (yaw rate) sensors) that outputs a variable 0-5V signal may be read with 10-bit resolution on these inputs. The digital I/O pins may be configured individually as either inputs or outputs in the user's program. Normally, when configured as inputs these pins accept signals of either 0 Volts or 5 Volts from sources such as switches or other external circuitry, where a 0V signal will be read as a logic 0 in the software and a 5V signal on the pin will be read as a logic 1. The most common use for digital inputs is for the connection of switches, which may be wired individually, in parallel, or in series. Further, some or all digital I/O pins can be configured as hardware interrupts.

With respect to the example microprocessors, OVPC 104 may comprise, for example, a central processing unit (CPU), an application specific integrated circuit (ASIC), a microcontroller (such as PIC18F8520), or a field-programmable gate array (FPGA) and is meant to include one or more processors where applicable. For example, there may be two microcontrollers: a first processor that handles radio and tether communications, generates most of the PWM output signals, and oversees the general operations; and a second processor that is programmable by a user to take input data, determine what to do with outputs to make the robot behave as desired, and set PWM and Relay outputs to the appropriate states. In certain embodiments, the microprocessor executes resident software such as a control module application. The control module application comprises any combination of hardware, firmware, or software (collectively "software") operable to manage at least a portion of control system and/or the coupled device, such as the robot. For example, the control module application may comprise two sub-modules, a master module and a user-defined module, as appropriate. Each module or sub-module may be partially or completely written or described in any appropriate computer language including C, C++, Java, Visual Basic, assembler, Perl, any suitable version of 4GL, and others or any combination thereof. Of course, the features and functionality performed by this application may be consolidated within a single module as well. Indeed, the control module application may comprise one of a plurality of sub-modules of a parent application or module (not illustrated). Further, the sub-modules may be collectively stored in one file or flash memory or distributed across a plurality of files or memories without departing from the scope of the disclosure.

In some embodiments, the receiver module 218 may receive control signals from the transmitter 106 and send the received signals to the OVPC 104. In some embodiments, communications between the receiver 218 and OVPC module 104 may be carried by one signal wire. In some embodiments, the received control signals may configure the OVPC 104 to control the rotational direction and/or speed of the motors 212-214. For example, the control signals may indicate that the robot 102 should move in an arc. In the illustrated example, the OVPC module 104 may respond to the control signal by driving the motor 212 at one speed and drive the motor 214 at a greater speed, thereby causing the robot to travel in an arc. Generally, motors are devices that can transform electrical energy into mechanical energy. That is, they take electrical power, and create physical motion. In the present example system, motors are further divided into two main types: standard motors and servomotors. Standard motors spin the attached axle around and around, while servomotors turn the axle to face a specific direction within their range of motion (perhaps 120 degrees).

The robot 102 may also include one or more sensors to help the robot sense its environment adjust its own behaviors based on that knowledge. A sensor can generally tell the robot about one very simple thing in the environment and the robot's program will interpret that information to determine how it should react. Generally, these sensors may be analog or digital. Analog sensors communicate with the OVPC 104 by sending it an electrical voltage along a wire. By measuring where the sent voltage falls between zero and maximum voltage, the OVPC 104 can interpret the voltage as a numeric value for processing. Analog sensors can therefore detect and communicate any value in a range of numbers. On the other hand, a digital sensor sends a voltage, like an analog sensor, but instead of sending a voltage between zero and maximum, it will send zero OR maximum (say "1"). If the OVPC detects a voltage that is between the two, it assumes that the difference is caused by electrical noise, and rounds the voltage either up to maximum, or down to zero, whichever is closer. The bumper sensor, for instance, will tell the robot whether it is in contact with a physical object or not, typically via digital signals. Illustrated robot 102 includes a bump sensor 222 and a bump sensor 224. In some embodiments, the bump sensors 222-224 may be communicatively coupled to the OVPC module 104. For example, the bump sensors 222-224 may be normally closed switches, and when the bump sensor contacts an object the switch circuit may open to cause the sensors 222-224 to send a "bump" signal to the OVPC module 104.

The robot 102 can include an ultrasonic range finder module 226 that is rotatably coupled to a servo 228. In some implementations, the ultrasonic range finder module 226 may send signals to the OVPC module 104 to indicate a distance between the ultrasonic range finder module 226 and another object. In some implementations, the OVPC 104 may control the servo 228 to orient the ultrasonic range finder module 226 at one or more angles within the range of motion of the servo 228. For example, the OVPC module 104 may command the servo 228 to rotate the ultrasonic range finder module 226 to a commanded angle and measure a distance using the ultrasonic range finder 226, and using the angle value and the distance value the OVPC module 104 may determine a distance and a heading to an object. The OVPC module 104 may also cause the servo 228 to "sweep" the ultrasonic range finder module 226 through a collection of angles to measure a collection of distance measurements, and use the collection of angle and distance data to form a representation of the area in front of the robot 102 (e.g., a sonar map).

The example robot 102 includes an infrared (IR) detector module 230 that is rotatably coupled to a servo 232. The OVPC module 104 communicates with the servo 232 to command the servo 232 to position the IR detector module 230 at an angle within the servo's 232 range of motion. For example, the task of the robot 102 may be to seek and/or avoid various IR beacons (e.g., an IR emitting target or ball, goal, home base, another robot, a recharging station). In the illustrated example, the robot 102 may sweep the IR detector module 230 through a number of angles to find an angle that causes the IR detector module 230 to indicate a strongest signal, and this angle may indicate the direction of an IR beacon. The OVPC module 104 may then use the angle associated with the strongest IR signal to drive the robot 102 toward or away from the beacon.

Figure 3A:
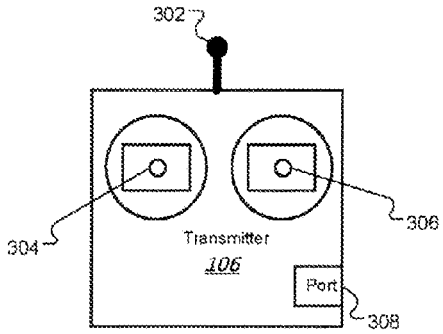
FIGS. 3A-D illustrate various examples of the transmitter, perhaps operable to be linked to various devices, such as a central controller or the robot, by tether cables.

FIGS. 3A-3D illustrate example transmitters, central controllers, and robots variously linked by tether cables. For example, FIG. 3A shows a transmitter 106. that includes an antenna 302, a left joystick 304, a right joystick 306 and optionally a tether port 308. This (typically multi-function) tether port 308 is operable to communicably link with the central controller 136 and/or the robot 102 as appropriate. As described above, the tether port generally represents any port intended to connect to an operator interface using a "hard" wire connection—such as a DB9 Female-Female Pin-to-Pin cable or a telephone handset extension cable—instead of using a wireless radio link. In some embodiments, the joysticks 304-306 are used by the robot operator to control one or more functions of the robot 102.

Figure 3B:
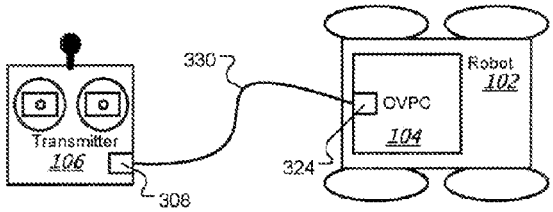

For example, the user may control the robot 102 using a wired connection. FIG. 3B illustrates the transmitter 106 tethered to the robot 102 via the OVPC 104. Particularly, the transmitter includes the tether port 308 and the OVPC module 104 includes an OVPC tether port 324. The transmitter 106 communicates control signals between the tether port 308 and the OVPC tether port 324 through a tether cable 330. In some embodiments, the transmitter 106 may sense the direct communications with the OVPC 104 and disable the transmitter's 106 wireless communication capabilities. Further, the OVPC 104 may sense the direct communications with the transmitter 106 and disable a wireless receiver (such as the receiver 218). Using such tethers, it may be useful to plug the transmitter directly into the OVPC and specifically bypass the receiver for diagnostic purposes. For example, this may help determine whether radio interference is at fault for the robot behaving strangely or if some other factor is to blame by communicating with the robot 102 through a wired connection.

In other situations, the OVPC tether port may be part of the wireless receiver, which is communicably coupled to the OVPC (perhaps via one signal wire as described below). Accordingly, the transmitter 106 communicates to the receiver using the tether cable 330 (in addition to or as a replacement of wireless communications). The receiver would then transmit this information to the OVPC 104 for (occasionally further) processing. In some of these cases, the receiver components and functionality may be embedded within the OVPC 104, thus forming a unitized receiver/OVPC module.

Figure 3C:
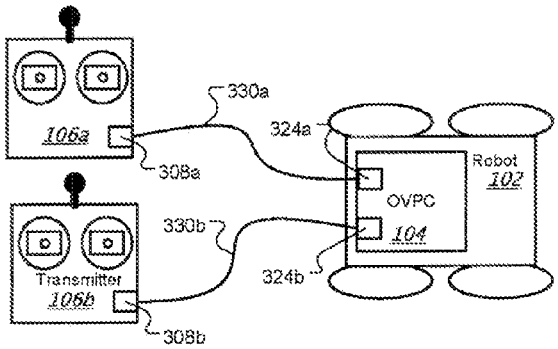

Certain OVPCs 104 can simultaneously support two transmitters and receivers on different frequencies or using one or two tether cables 330 coupled to two tether ports 324A and 324B. Specifically, FIG. 3C illustrates two transmitters 106 tethered to one robot 102. The addition of the second transmitter 106 (and perhaps receiver) can provide added functionality to the robot 102, often enabling two human operators to control different aspects of the same robot. One common use for such functionality is for one person to control the motion of the robot 102 (by driving it), while the other person controls articulation of the robot 102 (the operation of a robotic arm or other attachment). In some cases, the OVPC 104 may detect that either or both transmitters 106 are connected via the respective tether port 324A or 324B. In other situations, the second transmitter 106 and receiver may include a different crystal set from the first transmitter and receiver. For example, the second transmitter may use 75 MHz channel 89 (75.970 MHz), enabling the operator to use both sets of transmitters and receivers at the same time without causing radio interference. The OVPC 104 can often automatically detect the presence of the second receiver module on the robot 102 (once it is plugged in) and switch over to dual transmitter controls.

Figure 3D:
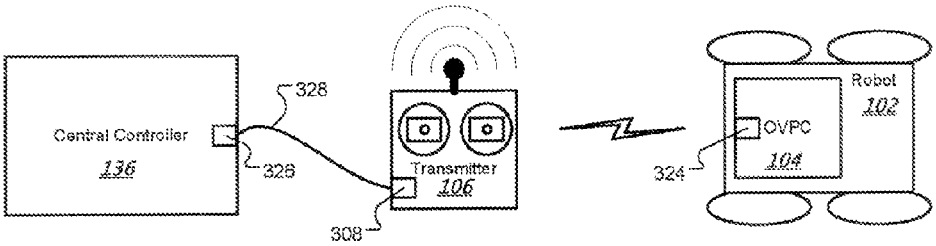

FIG. 3D illustrates the transmitter 106 tethered to the central controller 136 and wirelessly communicating with the robot 102. The central controller 136 includes a tether port 326 and is tethered to the transmitter's 106 central controller tether port 308 by a tether cable 328. The transmitter 106 may sense that the transmitter 106 is tethered to the central controller 136 and may be automatically disable its wireless communications until instructed otherwise by central controller 136. In other words, as described above, the central controller 136 may remotely enable and/or disable the transmitter 106. In the illustrated example, the central controller 136 is tethered to one transmitter 106, but the central controller may be tethered to any appropriate number of transmitters 106 (as shown in FIG. 1).

Figure 4A:
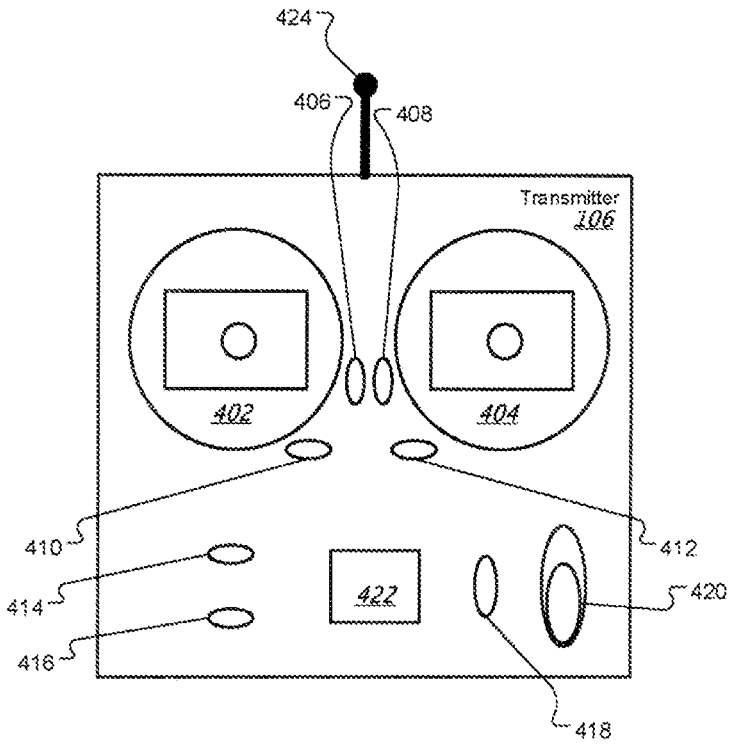
FIGS. 4A-B show front and back views of an example transmitter that includes ergonomic buttons according to one implementation of the present disclosure.
Figure 4B:
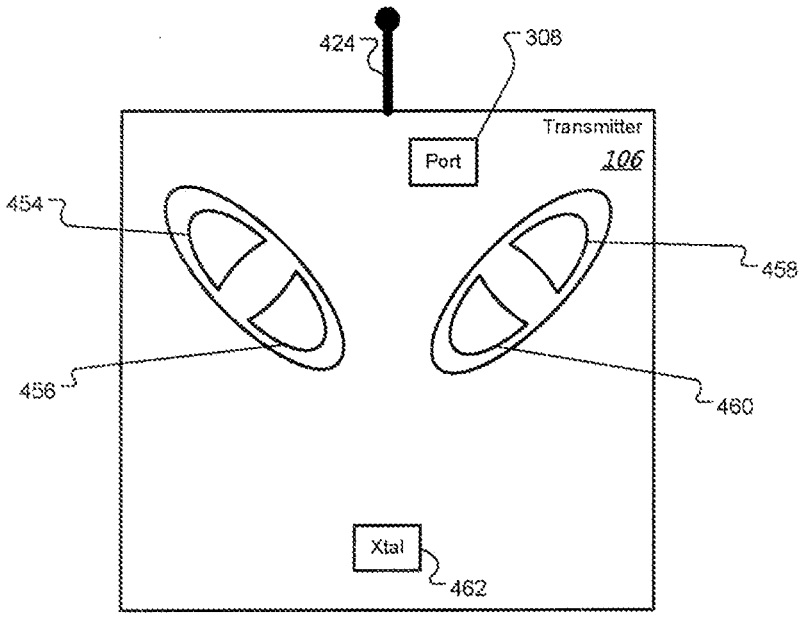

FIGS. 4A-4B show front and back views of one transmitter 106 that includes ergonomic buttons. In these examples, the transmitters may have a Control Frequency Channel 89, 75.970 MHz and 6 channels (4 Analog and 2 Digital). For example, the transmitter may include 2 analog channels for the potentiometers (or joysticks), each with an X and Y axis and 4 digital channels for the momentary switches or other ergonomic controls (located on the backside from the joysticks). FIG. 4A illustrates a front view of the exemplary transmitter 106. The transmitter 106 includes a left joystick 402 and a right joystick 404. In some embodiments, the joysticks 402-404 may move in one or more axes. The transmitter 106 also includes joystick trimtabs 406-412 includes a collection of ergonomic buttons 414-418. In some embodiments, the buttons 406-420 may be momentary switches, toggle switches, sliders, pressure sensitive pads, or other devices that may translate a mechanical action to an electrical signal. The transmitter 106 includes a display 422 and an antenna 424. In some embodiments, the display 422 may be used to display transmitter status, robot status, configuration information, channel information, power status, tether status, remote transmitter disablement status, or other information. In some embodiments, the antenna 424 may be used to communicate wirelessly with the receiver 218.

FIG. 4B illustrates a back view of the transmitter 106. The back side of the example transmitter 106 may include a tether port 450, which can be used for various wired communications including transmitter-transmitter (such as for training), transmitter-robot, and transmitter-central controller. The back of the transmitter 106 also includes a collection of ergonomic buttons 454-460 (e.g., momentary switches, toggle switches, sliders, pressure sensitive pads). In some embodiments, the buttons 454-460 may be placed in locations that may allow a user to hold the transmitter in a natural position and operate the buttons 454-460 in a comfortable manner. In some embodiments, the buttons 454-460 may be raised, recessed, domed, scalloped, textured, grouped, or otherwise designed in a manner that may provide the user with an ergonomic feel for operating the buttons 454-460.

In certain implementations, one or more of the buttons 406-418 and/or the buttons 454-460 may be associated with a control matrix used by the OVPC module. For example, the user may press the button 406 and the OVPC may respond by altering the electrical state of one or more sections of a control matrix. In some examples, altering the state of one or more sections of the control matrix may allow the user to control the behavior of the robot 102. This control matrix may be configurable by the operator (or other person interacting with the transmitter). For example, the control matrix may be configured to allow button 458 to close a gripper and the button 460 to open the gripper, and the control matrix may be reconfigured to cause the button 458 to open the gripper and the button 460 to close the gripper. Such configuration may, for instance, occur directly in the transmitter or may occur at a client computer and downloaded (or flashed) to the transmitter.

The illustrated transmitter 106 also includes a transmitter crystal 462. In some embodiments, the transmitter crystal 462 may be used to cause the transmitter 106 to operate on one or more transmission frequencies. In some embodiments, the transmitter crystal 462 may be removed and replaced by a replacement transmitter crystal. For example, the user may replace the transmitter crystal 462 to change the frequency or range of frequencies upon which the transmitter 106 may transmit control signals.

Figure 5A:
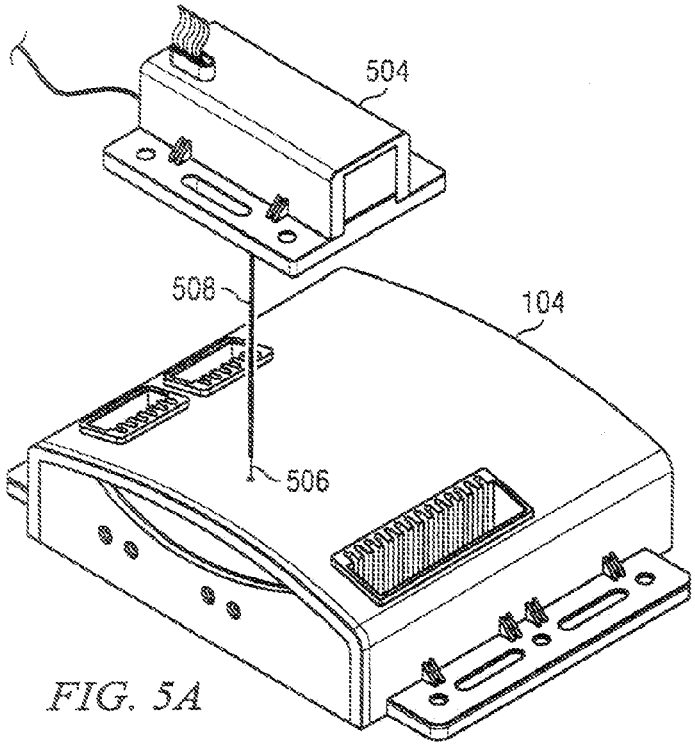
FIGS. 5A-B illustrate two example configurations of receivers and on-vehicle programmable controllers that are linked by single signal wires according to one implementation of the present disclosure.
Figure 5B:
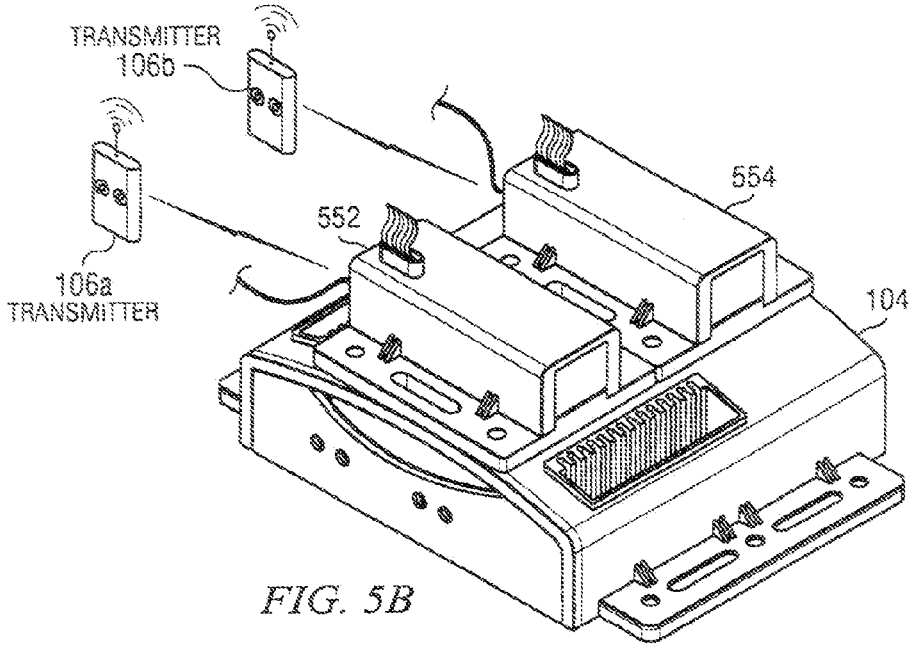

FIGS. 5A-5B illustrate two example configurations of receivers and on-vehicle programmable controllers that are linked by single signal wires. FIG. 5A illustrates an exemplary combination of an OVPC module 104 and a receiver 504. The OVPC module 104 includes a single signal port 506. In some embodiments, the single signal port and the receiver 504 may be coupled and a substantial portion of the receiver-controlled communications by may occur through a single signal wire 508. In some embodiments, the data communicated through the single signal wire may be multiplexed data.

FIG. 5B illustrates an example OVPC module 104, a first receiver 552, and a second receiver 554. In the illustrated example, the OVPC module 104 includes two single signal ports (not shown). The two single signal ports are communicatively coupled to the first receiver 552 and the second receiver 554 by two single signal wires (not shown). The first receiver 552 is communicatively coupled to a first remote control transmitter 106A. The second receiver 554 is communicatively coupled to a second remote control transmitter 106B. In some embodiments, the receivers 552-554, in communication with the transmitters 106A-106B, may allow two users to operate concurrently a user-configurable device such as a robot. For example, a robot may have more actuators and/or other remotely controllable functions than can be controlled by one user operating one transmitter. In the illustrated example, two users may concurrently operate the robot, for example, with one user "driving" the robot while the other user operates the robot's actuators (e.g., grippers, weapons, end effectors).

A number of implementations have been described. In other words, the prior described R/C systems, with accompanying specifications and details, are for example purposes only and other implementations are within the scope of this disclosure. For example, a smaller hobby controller may be used with fewer input and outputs. In another example, a faster or more powerful controller (or microprocessor) may be used to control more advanced robots or other devices. Moreover, a particular R/C system may implement one, some, or all of the foregoing example enhancements without departing from the scope of the disclosure. For example, the particular R/C system may include the ability to pass data between the receiver and the OVPC with only one signal wire and the ability to remotely disable the transmitter. Another R/C system may include only the non joystick inputs that are reconfigured for more ergonomic control. In another example, a particular R/C system may fall within the following example logic and structure sections, but have substantially different power and microcontroller modules and remain within the scope of this disclosure. Another R/C system could comply with many of the specifications of the following example logic, motion, and structure sections, but have substantially different power and microcontroller modules and remain within the scope of this disclosure. In short, many modifications, substitutions, or other embodiments are well within the scope of this invention. Accordingly, other implementations are within the scope of the following claims.

What is claimed is:

1. System for controlling a user-configurable device comprising:

the user-configurable device including an on-vehicle programmable controller and a first tether port, wherein the user-configurable device is configured to receive both modulated signals and unmodulated signals; and a remote control transmitter with at least one wireless output and a second tether port, the transmitter configured to wirelessly communicate, through the at least one wireless output, modulated signals to the user-configurable device and configured to communicate, through the second tether port, unmodulated signals to the user-configurable device through the first tether port;

said user-configurable device comprising a robot;

said on-vehicle programmable controller including the first tether port and the transmitter communicating directly to the on-vehicle programmable controller with a tether cable attached to the first tether port;

said transmitter detecting the direct communications and disabling at least one of the wireless outputs; and further comprising a central controller comprising a third tether port with a tether cable attached to the third tether port and communicating wirelessly with the on-vehicle programmable controller via a wireless receiver, said central controller operable to temporarily disable said transmitter.

2. The system of claim 1, wherein the on-vehicle programmable controller is further coupled with a wireless receiver.

3. The system of claim 2, wherein the on-vehicle programmable controller is further configured to detect the direct communications and configured to disable the wireless receiver.

4. The system of claim 2, wherein the on-vehicle programmable controller is further configured to communicate wirelessly with a second transmitter via the wireless receiver.

5. The system of claim 1, wherein the central controller is further tethered with a plurality of other transmitters and operable to temporarily disable the plurality of other transmitters.

6. The system of claim 5, wherein the central controller is operable to concurrently enable the tethered transmitters.

7. The system of claim 1, wherein the transmitter comprises at least one ergonomic momentary control.

8. The system of claim 7, wherein the transmitter comprises four ergonomic momentary controls and at least one joystick, and at least a subset of these four ergonomic momentary controls are further located on the transmitter away from the at least one joystick.

9. The system of claim 8, wherein the four ergonomic momentary controls are further associated with a control matrix, and the control matrix is configured by the on-vehicle programmable controller.

10. The system of claim 9, wherein the control matrix is configurable by a user.

11. The system of claim 1, further comprising a wireless receiver coupled to the on-vehicle programmable controller via one signal wire, wherein a substantial portion of the receiver-controlled communications occur using the one signal wire.

12. The system of claim 1, wherein the wireless receiver is embedded within the on-vehicle programmable controller.

* * * * *